US008684507B2

(12) United States Patent
Uezawa

(10) Patent No.: US 8,684,507 B2
(45) Date of Patent: Apr. 1, 2014

(54) LIQUID EJECTING HEAD, LIQUID EJECTING UNIT, AND LIQUID EJECTING APPARATUS

(75) Inventor: Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 59 days.

(21) Appl. No.: 13/076,334

(22) Filed: Mar. 30, 2011

(65) Prior Publication Data

US 2011/0242236 A1 Oct. 6, 2011

(30) Foreign Application Priority Data

Mar. 31, 2010 (JP) ..... 2010-081517

(51) Int. Cl.
*B41J 2/18* (2006.01)

(52) U.S. Cl.
USPC ..... 347/89

(58) Field of Classification Search
USPC ..... 347/89, 93
See application file for complete search history.

(56) References Cited

U.S. PATENT DOCUMENTS

| | | | | |
|---|---|---|---|---|
| 4,607,261 A * | 8/1986 | McCann et al. | ..... | 347/86 |
| 6,116,727 A * | 9/2000 | Hagiwara | ..... | 347/89 |
| 7,537,328 B2 * | 5/2009 | Okubo | ..... | 347/93 |

FOREIGN PATENT DOCUMENTS

| | | | |
|---|---|---|---|
| JP | 2000-103075 A | | 4/2000 |
| JP | 2007-069419 A | | 3/2007 |
| JP | 2009-023289 A | * | 2/2009 |
| JP | 2009-023289 A | * | 2/2009 |
| JP | 2009-141890 A | * | 2/2009 |

* cited by examiner

*Primary Examiner* — Alessandro Amari
*Assistant Examiner* — Michael Konczal
(74) *Attorney, Agent, or Firm* — Kilpatrick Townsend & Stockton LLP

(57) ABSTRACT

A liquid ejecting head comprising, a plurality of nozzle openings, a first flow passage, a circulation flow passage, a filter chamber, and a bypass flow passage, an inner diameter of the bypass flow passage is larger than a diameter of the hole of the filter, the inner diameter of the bypass flow passage is larger than a diameter of the nozzle opening, and a flow passage resistance of the bypass flow passage is larger than a flow passage resistance of the circulation flow passage from a branch point where the bypass flow passage branches from the supply passage to a junction point where the bypass flow passage merges into the collection passage.

11 Claims, 6 Drawing Sheets

LIQUID EJECTING HEAD, LIQUID EJECTING UNIT, AND LIQUID EJECTING APPARATUS

The entire disclosure of Japanese Patent Application No: 2010-081517, filed Mar. 31, 2010 are expressly incorporated by reference herein.

BACKGROUND

1. Technical Field

The present invention relates to a liquid ejecting head, a liquid ejecting unit, and a liquid ejecting apparatus.

2. Related Art

A circulation-type apparatus is known in the field of an ink-jet recording apparatus, which is an example of a liquid ejecting apparatus. In a known circulation-type ink-jet recording apparatus, for example, one disclosed in JP-A-2009-23289 (in particular, refer to FIG. 3), an ink tank is provided at a distance from an ink-jet recording head. Ink flows from the ink tank to the ink-jet recording head, and then back to the ink tank in a circulatory manner.

In the ink-jet recording apparatus disclosed in JP-A-2009-23289, a single tube on an outgoing channel and a single tube on a return channel are connected to the ink tank. A plurality of branch tubes is branched from the outgoing tube. Each of the outgoing branch tubes is connected to the corresponding one of a plurality of recording heads for supplying ink thereto. A plurality of branch tubes is branched from the return tube. Each of the return branch tubes is connected to the corresponding one of the plurality of recording heads for collecting ink therefrom. Each of the plurality of recording heads has a flow passage for circulation. With a circulatory flow, it is possible to suppress the precipitation of components in liquid while making it easier to let out air bubbles.

The ink-jet recording apparatus disclosed in JP-A-2009-23289 has the following problem. A filter that is provided in a filter chamber traps air bubbles. The trapped air bubbles cover the upper surface of the filter to clog it up completely, which obstructs the circulatory flow of ink. Because the circulation of ink is hampered, the print performance of the ink-jet recording apparatus decreases. The above problem is not unique to a liquid ejecting apparatus that is provided with an ink-jet recording head(s). That is, the same problem could also arise in various kinds of liquid ejecting apparatuses provided with a liquid ejecting head(s) for ejecting liquid, which is not limited to ink.

SUMMARY

An advantage of some aspects of the invention is to provide a liquid ejecting head that makes it possible to prevent a filter from becoming clogged up. Another advantage of some aspects of the invention is to provide a liquid ejecting unit or a liquid ejecting apparatus that is provided with such a liquid ejecting head(s) with improved liquid ejection characteristics.

A liquid ejecting head according to a first aspect of the invention includes: a plurality of nozzle openings through which liquid is ejected; a first flow passage that is in communication with the plurality of nozzle openings, the liquid flowing through the first flow passage; a circulation flow passage that includes a supply passage and a collection passage, the supply passage being a passage through which the liquid supplied from the outside flows to be supplied to the first flow passage, the collection passage being a passage through which the liquid is collected from the first flow passage to the outside; a filter chamber that is formed as a widened part of the supply passage and thus has an inner diameter larger than that of the other part of the supply passage, a filter being provided inside the filter chamber, the filter having surfaces that extend transversely across the supply passage, a plurality of holes being formed through the filter; and a bypass flow passage that is formed in communication with the filter chamber, an upstream part of the supply passage, which is located upstream of the filter, being in bypass communication with the collection passage through the bypass flow passage, wherein an inner diameter of the bypass flow passage is larger than a diameter of the hole of the filter, the inner diameter of the bypass flow passage is larger than a diameter of the nozzle opening, and a flow passage resistance of the bypass flow passage is larger than a flow passage resistance of the circulation flow passage from a branch point where the bypass flow passage branches from the supply passage to a junction point where the bypass flow passage merges into the collection passage. Since the bypass flow passage has the above features, ink does not flow into the bypass flow passage easily when there is no air bubble trapped by the filter inside the filter chamber. In addition, when air bubbles trapped by the filter join and grow to stagnate inside the filter chamber, the air bubble(s) can escape through the bypass flow passage to be let out. By this means, it is possible to avoid the upper surface of the filter from being covered completely. Since the filter will not be clogged up, the circulatory flow of ink will not be obstructed.

In a liquid ejecting head according to the first aspect of the invention, it is preferable that the bypass flow passage should be formed at an upstream side with respect to the filter of the filter chamber above a midpoint of the filter chamber in a vertical direction. With such a preferred structure, since the bypass flow passage is formed at the position described above, an air bubble closes the bypass flow passage, thereby preventing ink from flowing into the bypass flow passage in a predetermined case.

In a liquid ejecting head according to the first aspect of the invention, it is preferable that the supply passage should not be concentric with the filter chamber. In such a preferred structure, since the supply passage is not concentric with the filter chamber, it is likely that an air bubble will stagnate inside the filter chamber at a region where the center axis of the supply passage does not pass through. Thus, the air bubble stagnating thereat can escape through the bypass flow passage easily. In addition, the air bubble does not obstruct the circulatory flow of ink, which is desirable.

A liquid ejecting head unit according to a second aspect of the invention includes a plurality of the liquid ejecting heads described above. Having the plurality of liquid ejecting heads, the liquid ejecting head unit can eject liquid excellently when mounted on a liquid ejecting apparatus.

A liquid ejecting apparatus according to a third aspect of the invention includes the liquid ejecting head described above or a plurality of the liquid ejecting heads described above. Having the liquid ejecting head(s), the liquid ejecting apparatus can eject liquid excellently.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
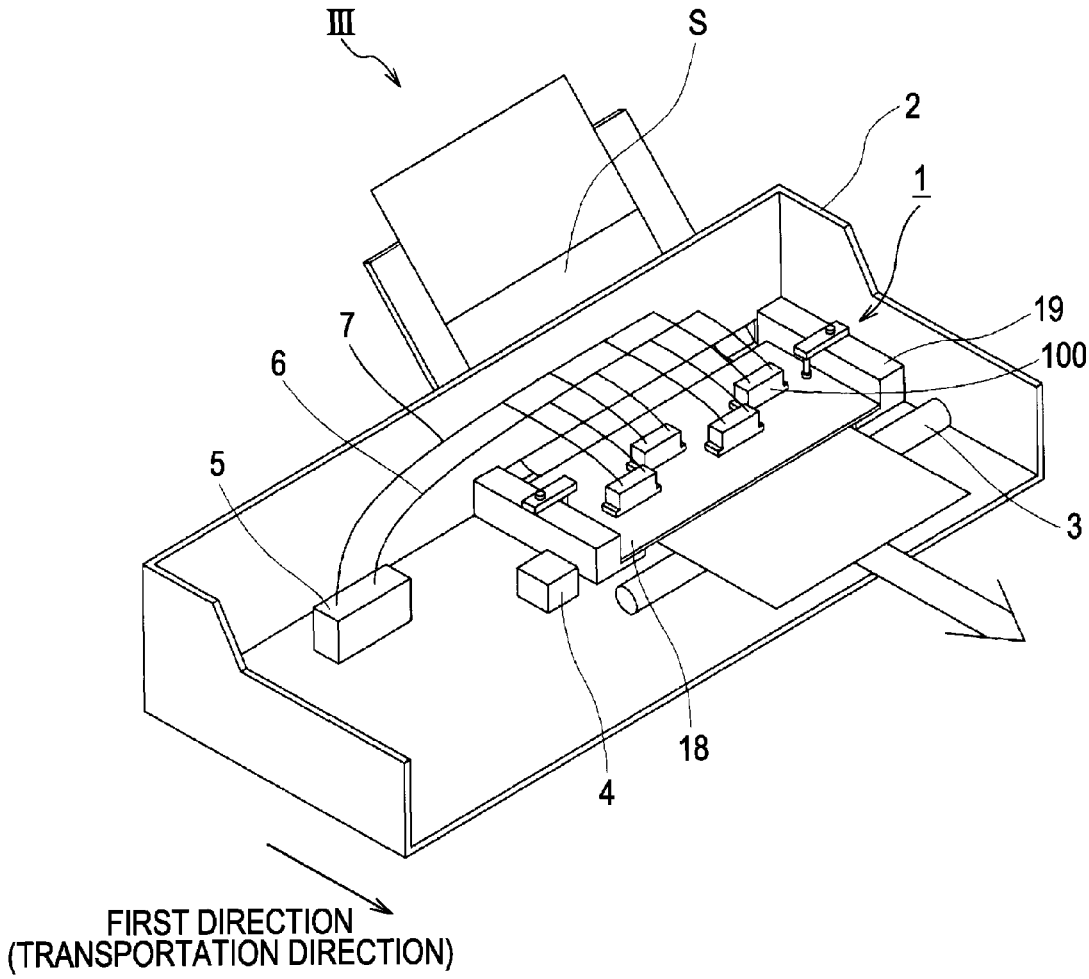
FIG. 1 is a perspective view that schematically illustrates an example of the structure of a liquid ejecting apparatus according to an exemplary embodiment of the invention.

With reference to FIGS. 1 to 6, a liquid ejecting apparatus according to an aspect of the present invention will now be explained. An ink-jet recording apparatus according to the present embodiment of the invention is a so-called line ink-jet printer (recording apparatus) that is equipped with liquid ejecting heads fixed to the body of the apparatus. The apparatus prints an image on the surface of a recording target medium such as a sheet of printing paper while transporting it in the direction orthogonal to the direction of nozzle lines. An ink-jet recording apparatus III illustrated in FIG. 1 includes a head unit 1, an apparatus body 2, a paper-feed roller 3, and a control unit 4. The paper-feed roller 3 is an example of a target-moving means.

The head unit 1 includes a head group and a base plate 18. The head group is made up of a plurality of liquid ejecting heads (hereinafter referred to as "heads") 100. In the illustrated example of FIG. 1, four heads 100 are mounted on the base plate 18. A pair of frame members 19, which is fixed to the base plate 18, is provided for fixing the head unit 1 to the apparatus body 2.

The paper-feed roller 3 is provided in the apparatus body 2. The paper-feed roller 3 transports a recording sheet S (recording target medium) such as paper that is fed into the apparatus body 2 in a first direction. During the transportation, the recording sheet S passes under the ink-discharging surface of each of the heads 100. The term "the first direction" means the direction of the relative movement of the recording sheet S and the heads 100. In the present embodiment of the invention, since the head unit 1 is fixed to the apparatus body 2, the paper-feed roller 3 transports the recording sheet S for the relative movement.

The control unit 4 sends a signal to the paper-feed roller 3, thereby causing the paper-feed roller 3 to rotate for transporting the recording sheet S on the basis of print data, which represents an image that is to be printed on the recording sheet S. In addition, on the basis of the print data, the control unit 4 sends a signal to each of the heads 100 via a line that is not illustrated in the drawings, thereby causing the head 100 to eject ink.

An ink-containing means 5 that contains ink is provided in the apparatus body 2. As will be described in detail later, in the present embodiment of the invention, an ink supply tube 6 through which ink is supplied from the ink-containing means 5 to each of the heads 100 and an ink collection tube 7 through which some ink is collected from each of the heads 100 back into the ink-containing means 5 are connected to the ink-containing means 5. More specifically, in the present embodiment of the invention, ink is supplied from the ink-containing means 5 to the ink flow passage (liquid flow passage) of each of the heads 100 through the ink supply tube 6, which is connected to the ink-containing means 5. Ink that is left at each of the heads 100 without being ejected through the nozzle orifices thereof is collected therefrom back into the ink-containing means 5 through the collection tube 7, which is connected to the ink-containing means 5. The ink-containing means 5 is equipped with a heating means that is not illustrated in the drawings. The heating means heatsink inside the ink-containing means 5. As described above, an ink-jet recording apparatus according to the present embodiment of the invention includes an ink circulation passage that is made up of the supply tube 6, the collection tube 7, and the ink flow passage of each of the heads 100. Heated ink flows from, and back to (if not consumed), the ink-containing means 5 in a circulatory manner.

The ink-jet recording apparatus III prints an image or the like on the recording sheet S by ejecting ink from the heads 100 of the head unit 1 while transporting the recording sheet S in the first direction by means of the paper-feed roller 3.

Figure 2:
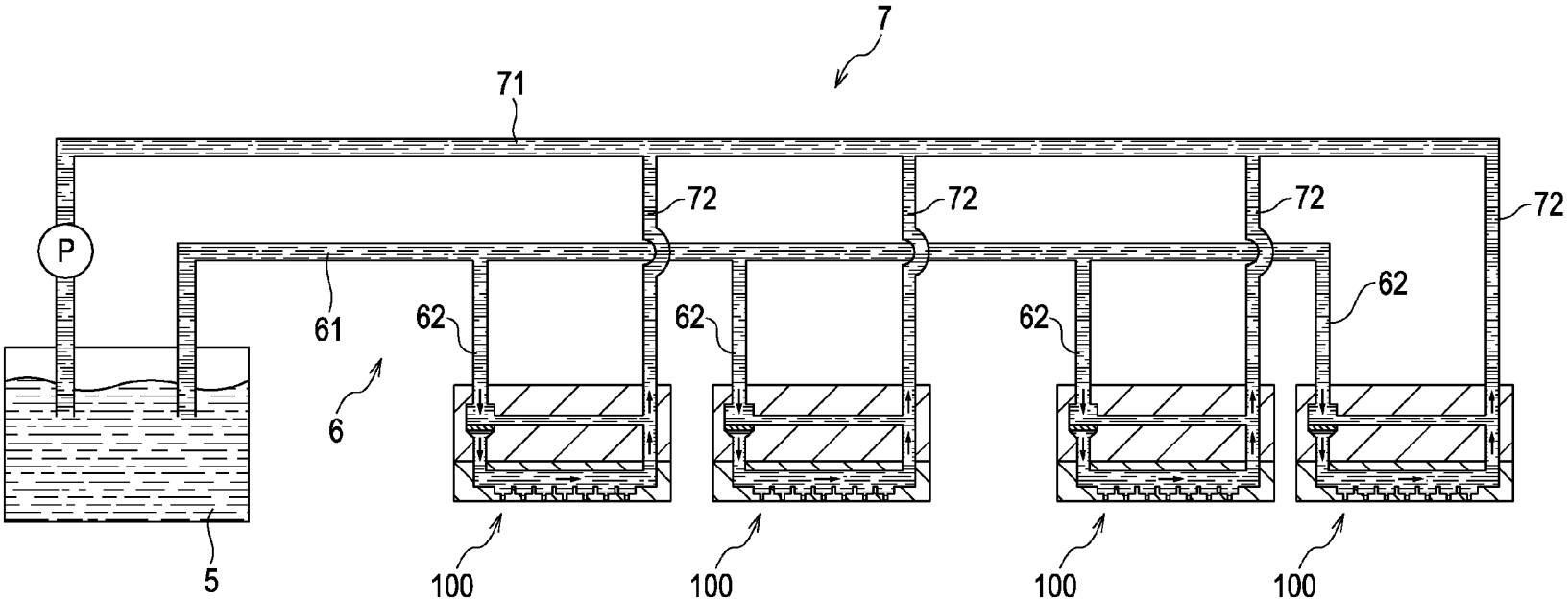
FIG. 2 is a diagram that schematically illustrates an example of the structure of liquid flow passages according to an exemplary embodiment of the invention.
Figure 3:
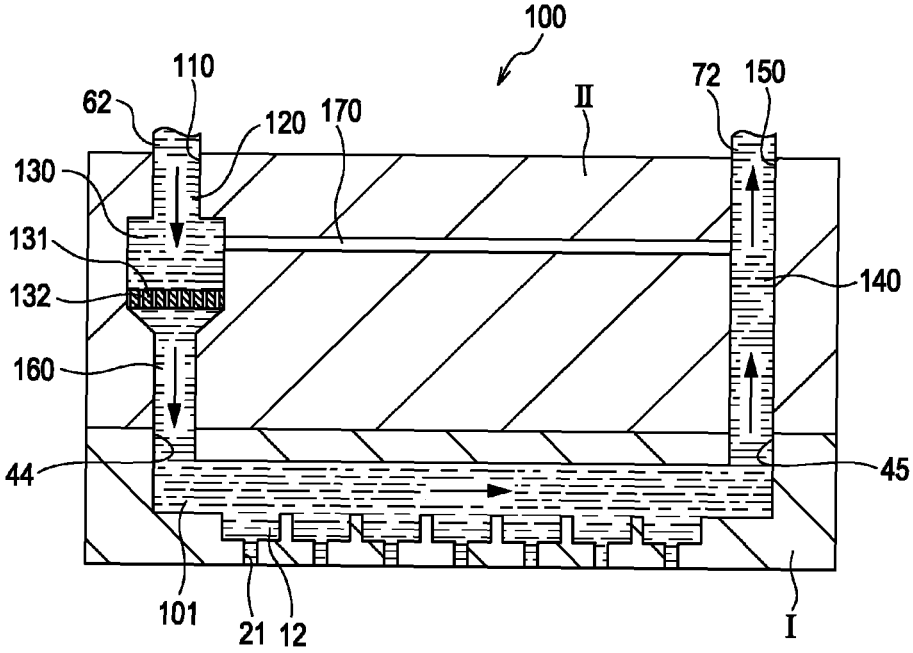
FIG. 3 is a sectional view that schematically illustrates an example of the structure of a head according to an exemplary embodiment of the invention.
Figure 4:
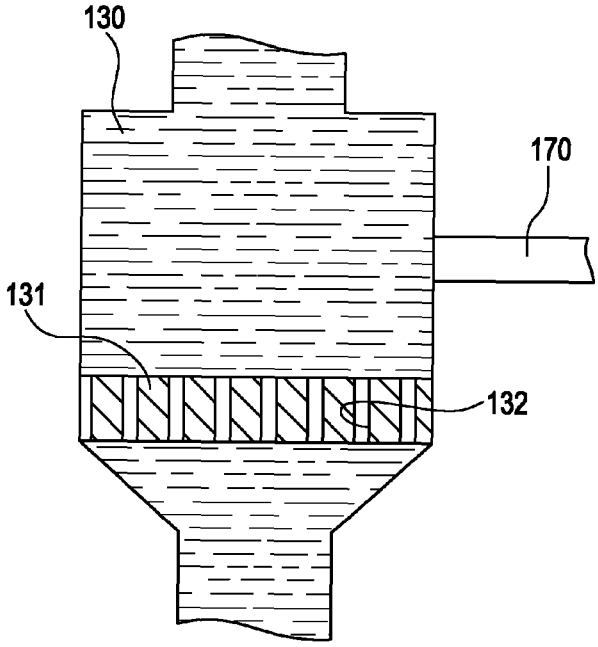
FIG. 4 is a fragmentary sectional view that schematically illustrates an example of the structure of a part of the head, specifically, a filter chamber.

With reference to FIGS. 2 and 3, the structure of an ink circulation passage will now be explained in detail. In FIGS. 2 and 3, arrows show the flow of ink. As described above, an ink circulation passage is made up of the supply tube 6, the collection tube 7, and the ink flow passage of each of the heads 100.

The supply tube 6 is made up of a supply main 61, which is a single line for supplying ink, and a plurality of supply branches 62, which are lines branching from the supply main 61. The supply main 61 is connected to the ink-containing means 5. Each of the supply branches 62 is connected to the corresponding one of the heads 100 for supplying ink thereto. The collection tube 7 is made up of a collection main 71, which is a single line for collecting ink, and a plurality of collection branches 72, which are lines branching from (i.e., merging into) the collection main 71. The collection main 71 is connected to the ink-containing means 5. Each of the collection branches 72 is connected to the corresponding one of the heads 100 for collecting ink therefrom. A pump P is provided between the supply main 61 and the ink-containing means 5. Ink that is left at each of the heads 100 is collected therefrom back into the ink-containing means 5 through the collection tube 7 due to negative pressure applied by the pump P. The ink is thereafter supplied from the ink-containing means 5 to each of the heads 100 again through the supply tube 6. The ink is circulated in this way.

As illustrated in FIG. 3, each of the heads 100 is made up of a head body I (described in detail later) and a flow passage member II. A plurality of nozzle orifices 21 and a reservoir 101 are formed in the head body I. The reservoir 101 is in communication with the nozzle orifices 21. The reservoir 101 is an example of a first flow passage according to an aspect of the invention. An ink flow passage is formed in the flow passage member II between the supply branch 62 and the head body I. Another ink flow passage is formed in the flow passage member II between the head body I and the collection branch 72. An ink inlet port 110, an upper supply passage 120, a filter chamber 130, and a lower supply passage 160 are formed in the flow passage member II. The ink inlet port 110 is an opening formed at a region on the upper surface of the flow passage member II. The upper supply passage 120 is in communication with the ink inlet port 110. The filter chamber 130 is formed as a space that is in communication with the upper supply passage 120. The filter chamber 130 has an inner diameter larger than that of the upper supply passage 120. The lower supply passage 160 is located immediately downstream of the filter chamber 130. A filter 131 is provided inside the filter chamber 130. The filter 131 traps air bubbles, foreign particles, and the like to ensure that filtrated ink does not contain them, thereby preventing poor ink-discharging performance such as, for example, missing dots caused by air bubbles or the like or nozzle clogging caused by foreign particles or the like. In other words, the filter 131 is provided for preventing any air bubble, foreign object in ink, or the like from flowing to the downstream side. A sheet-like material that has a plurality of filter holes 132 can be used as the filter 131. For example, the filter 131 may be made of woven sheet metal having an ultra-fine mesh structure with a number of minute holes. A very thin micro-machined metal plate may be used as the filter 131. Air bubbles trapped by the filter 131 join and grow inside the filter chamber 130. Specifically, in the present embodiment of the invention, the filter chamber 130, which has an inner diameter larger than that of the upper supply passage 120 as described above, is designed to allow air bubbles that have risen to the ceiling of the filter chamber 130 in the vertical direction due to buoyancy to stagnate thereat.

A collection passage 140, an ink outlet port 150, and a bypass flow passage 170 are formed in the flow passage member II. The ink outlet port 150 is another opening formed at another region on the upper surface of the flow passage member II. The collection passage 140 is in communication with the ink outlet port 150. The bypass flow passage 170, which has an inlet that is located immediately upstream of the filter 131 of the filter chamber 130, is in communication with the collection passage 140. A more detailed explanation of the bypass flow passage 170 will be given later.

Filtrated ink flows from the lower supply passage 160 to the inside of the head body I. Specifically, the lower supply passage 160 is in communication with the reservoir 101 of the head body I through a first opening 44. The first opening 44 is formed through a compliance substrate of the head body I. The compliance substrate will be described later.

The reservoir 101 is a part of the liquid flow passage of the head body I. The reservoir 101 is in communication with a plurality of pressure generation chambers 12 and thus with the nozzle orifices 21, each of which is formed for the corresponding one of the pressure generation chambers 12. Ink is ejected through the nozzle orifices 21. In other words, the reservoir 101 is a common flow passage that is in communication with, and shared by, a plurality of individual flow passages each of which is formed for the corresponding one of the plurality of nozzle orifices 21. A second opening 45 is formed through the compliance substrate, which seals the reservoir 101. The reservoir 101 is in communication with the collection passage 140 through the second opening 45.

The upper supply passage 120 and the lower supply passage 160 make up a supply passage according to the present embodiment of the invention. In the head 100, the supply passage made up of the upper supply passage 120 and the lower supply passage 160, the reservoir 101, and the collection passage 140 make up a flow passage for circulation. Ink flows from the supply branch 62 to the collection branch 72 through the flow passage for circulation, which is formed in the head 100.

Next, the bypass flow passage 170 will now be explained. The bypass flow passage 170 is formed at the upstream side with respect to the filter 131 of the filter chamber 130 above the midpoint of the filter chamber 130 in the vertical direction, as viewed from the filter 131. The bypass flow passage 170 is formed for allowing an air bubble(s) to escape to the collection passage 140 therethrough when it stagnates inside the filter chamber 130. This can be explained in more detail with reference to FIG. 4 as follows. As the filter 131 traps air bubbles inside the filter chamber 130, the air bubbles rise to the ceiling of the filter chamber 130 one after another or as they join by twos and threes due to buoyancy to stagnate thereat. They join and grow gradually to become close to the filter 131. In this process, the air bubble starts to cover the upper surface of a part of the filter 131. Unless the air bubble (s) were let out in one way or another, the air bubble would cover the upper surface of the filter 131 completely to clog it up, which would obstruct the circulatory flow of ink.

In the present embodiment of the invention, since the bypass flow passage 170 is formed in the head 100 in communication with the filter chamber 130, the air bubble stagnating inside the filter chamber 130 is allowed to escape into the bypass flow passage 170 and then through the bypass flow passage 170 into the collection passage 140 before it would otherwise cover the upper surface of the filter 131 completely to clog it up. Therefore, the complete covering and clogging-up of the filter 131 does not actually occur. Thus, the circulatory flow of ink will not be obstructed completely. In addition, since air bubbles that have escaped through the bypass flow passage 170 into the collection passage 140 are collected therefrom together with unused ink, it is not necessary to perform cleaning operation in order to let out the air bubbles by ejecting ink through the nozzle orifices 21.

The structural specifications of the bypass flow passage 170 satisfy the following conditions in order to make the flowing of ink into the bypass flow passage 170 as hard as possible and make the escaping of air bubbles through the bypass flow passage 170 for letting them out as easy as possible.

As one of the conditions that the specifications of the bypass flow passage 170 satisfy, the inner diameter of the bypass flow passage 170 is larger than the diameter of the filter hole 132 of the filter 131 and, in addition, the inner diameter of the bypass flow passage 170 is larger than the diameter of the nozzle orifice 21. This is because, if the inner diameter of the bypass flow passage 170 is not larger than the diameter of the filter hole 132 of the filter 131 or if the inner diameter of the bypass flow passage 170 is not larger than the diameter of the nozzle orifice 21, an air bubble stagnating inside the filter chamber 130 flows through the filter 131 toward the reservoir 101 without escaping through the bypass flow passage 170 when pressure loss increases as will be described in detail later.

As another condition satisfied, the flow-passage resistance of the bypass flow passage 170 is larger than the flow-passage resistance of the flow passage for circulation from a branch point where the bypass flow passage 170 branches from the supply passage to a junction point, that is, a confluence where the bypass flow passage 170 merges into the collection passage 140 (hereinafter referred to as "reservoir-side flow-passage resistance") in a state in which there is not any air bubble therein. In other words, the flow-passage resistance of the bypass flow passage 170 is larger than the aggregate flow-passage resistance of a part of the filter chamber 130 downstream of the position where the inlet of the bypass flow passage 170 is formed, the lower supply passage 160, the reservoir 101, and a part of the collection passage 140 upstream of the position where the bypass flow passage 170 merges into the collection passage 140. Herein, the flow-passage resistance of the part of the filter chamber 130 downstream of the position where the inlet of the bypass flow passage 170 is formed includes the flow-passage resistance of the filter 131.

The reason why the above condition must be satisfied is as follows: if the flow-passage resistance of the bypass flow passage 170 is not larger than the reservoir-side flow-passage resistance, it is easier for ink to flow through the bypass flow passage 170, which decreases the amount of ink that flows into the reservoir 101; consequently, there is a risk of failing to attain desired ink-discharging performance. Seemingly, there is a possibility that ink might flow into the bypass flow passage 170 when the reservoir-side flow-passage resistance has become larger than the flow-passage resistance of the bypass flow passage 170 because of an increase in the reservoir-side flow-passage resistance due to the stagnation of an air bubble inside the filter chamber 130 as will be described later. However, in a case where the reservoir-side flow-passage resistance increases due to the above reason, the grown air bubble formed as a result of the joining of air bubbles closes the bypass flow passage 170, which is formed at the upstream side above the midpoint of the filter chamber 130. For this reason, the possibility that ink flows into the bypass flow passage 170 actually is very low even in such a case.

Even though the flow-passage resistance of the bypass flow passage 170 is larger than the reservoir-side flow-passage resistance, air bubbles do not flow into the reservoir 101. This is because, as described earlier, the inner diameter of the bypass flow passage 170 is larger than the diameter of the filter hole 132 and, in addition, the inner diameter of the bypass flow passage 170 is larger than the diameter of the nozzle orifice 21.

Since the specifications of the bypass flow passage 170 satisfy the above conditions, air bubbles that have joined and grown inside the filter chamber 130 to stagnate therein while covering the upper surface of a part of the filter 131 is allowed to escape into the bypass flow passage 170 and then through the bypass flow passage 170 into the collection passage 140, whereas ink does not flow into the bypass flow passage 170. Then, the air bubbles are collected therefrom together with unused ink. Therefore, in the present embodiment of the invention, it is possible to prevent the filter 131 from becoming clogged up. Specifically, air bubbles join and grow into a comparatively large air bubble inside the filter chamber 130. When the size of the air bubble reaches a certain size, it starts to cover the upper surface of a part of the filter 131, meaning that some of the filter holes 132 of the filter 131 are stopped up. As a consequence, the reservoir-side flow-passage resistance increases, resulting in an increase in pressure loss (flow-passage resistance) inside the filter chamber 130. When pressure loss increases inside the filter chamber 130, a force of flowing toward a side where resistance is comparatively low acts on the air bubble. The escaping (i.e., passing) of the air bubble through the bypass flow passage 170 is more stable thanks to its lower resistance than the flowing of it into the passage located downstream of the filter 131. For this reason, when the level of pressure loss exceeds a certain level of energy that is required when the air bubble escapes through the bypass flow passage 170, the air bubble enters the bypass flow passage 170.

The length and diameter of the bypass flow passage 170 satisfying the above conditions is determined depending on the physical property and flow rate of ink. For example, let the rate of flow of ink through the reservoir 101 be 0.1 g/s. Let the rate of flow of ink through the bypass flow passage 170 be 0.001 g/s. Let the viscosity of ink be 3 mPa·S. Let an angle of contact be 1°. Let surface tension be 25 mN/m. Given these values, the length and diameter of the bypass flow passage 170 is determined as follows.

First of all, the flow-passage resistance of the bypass flow passage 170, which is denoted as ΔP, can be expressed by the following formula:

$$\Delta P = \frac{8\eta L}{\pi d^4} U$$

where η denotes viscosity [Pa·S], d denotes the radius of the bypass flow passage 170 [m], L denotes the length of the bypass flow passage 170 [m], and U denotes flow rate [$m^3/s$].

Each of the flow-passage resistance of the bypass flow passage 170 and the reservoir-side flow-passage resistance is calculated under the above conditions. In addition, resistance at the filter 131 is estimated to be 210 Pa. Energy that is required when the air bubble escapes through the bypass flow passage 170, which is denoted as P, can be expressed by the following formula:

$$P = \frac{2r\cos\theta}{d}$$

where r denotes the surface tension of ink [N/m]; θ denotes an angle of contact [°].

Let us assume that ΔP≈P≈250 Pa (note that 250 Pa is an example for the value of ΔP and the value of P; preferably, it should be approximately 1 kPa or less) holds true. The flow-passage radius d and the flow-passage length L that satisfy this expression are calculated: the flow-passage radius d is 0.2 mm; the flow-passage length L is 52 mm.

To sum up, under the above conditions, it is possible to ensure that the bypass flow passage 170 fulfills the function described above by determining its dimension as follows: the diameter of the bypass flow passage 170 is 0.4 mm; the length L of the bypass flow passage 170 is 52 mm.

Next, the ink-ejecting operation of the liquid ejecting apparatus III according to the present embodiment of the invention will now be explained. In the process of its outbound flow, ink supplied from the ink-containing means 5 flows through the supply main 61 and the supply branch 62. Then, the ink flows into the ink inlet port 110 formed at a region on the upper surface of the flow passage member II of the head 100. Next, the ink flows through the upper supply passage 120. Thereafter, the ink is filtered at the filter 131. After the filtration, the ink flows through the lower supply passage 160 into the reservoir 101 of the head body I. The ink flows from the reservoir 101 into the plurality of pressure generation chambers 12.

Ink left inside the reservoir 101 is collected therefrom toward the ink-containing means 5 through the collection passage 140 due to negative pressure applied by the pump P. In addition, an air bubble is collected from the bypass flow passage 170 through the collection passage 140. At the same time, new ink is supplied to the head 100 through the supply tube 6. Ink circulates through the inside of the head 100 in this way.

Figure 5:
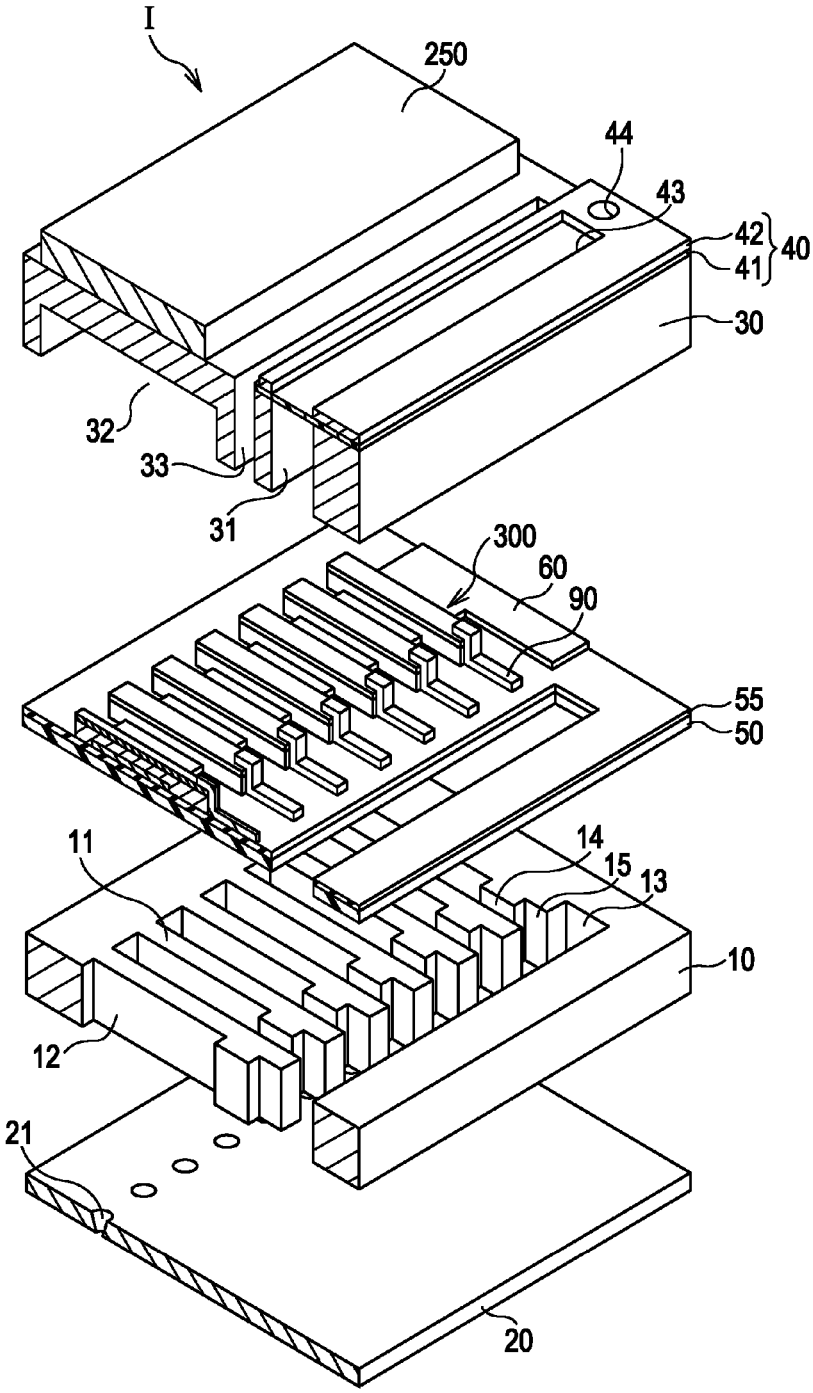
FIG. 5 is an exploded perspective view that schematically illustrates an example of the structure of the head.
Figure 6A:
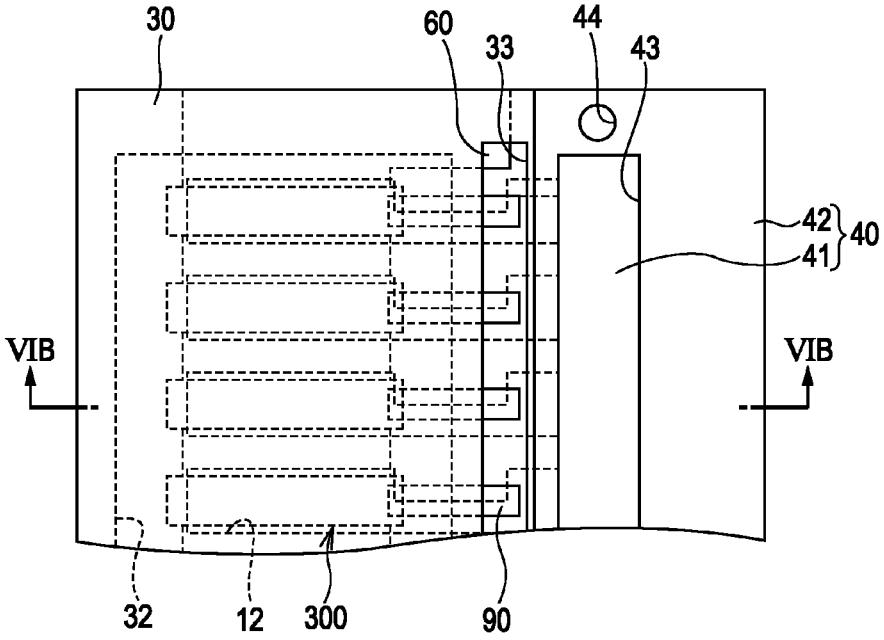
FIG. 6A is a plan view of the head.
Figure 6B:
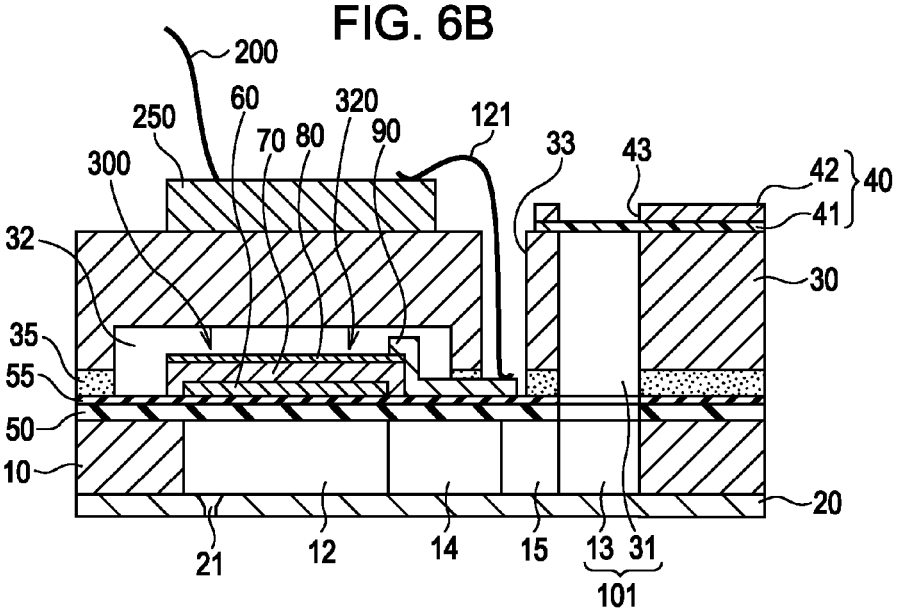
FIG. 6B is a sectional view of the head.

With reference to FIGS. 5 and 6, the structure of a liquid ejecting head body will now be explained. FIG. 5 is an exploded perspective view that schematically illustrates an example of the structure of an ink-jet recording head body, which is an example of a liquid ejecting head body according to an exemplary embodiment of the invention. FIG. 6A is a plan view of the ink-jet recording head body. FIG. 6B is a sectional view taken along the line VIB-VIB of FIG. 6A.

A fluid channel formation substrate 10 is made of a silicon single crystal substrate. As illustrated in these drawings, an elastic membrane 50 is formed on one surface of the fluid channel formation substrate 10. The elastic membrane 50 is, for example, a silicon dioxide film. A plurality of pressure generation chambers 12 is formed in the fluid channel formation substrate 10. The fluid channel formation substrate 10 has a plurality of walls 11 for partitioning itself into the plurality of pressure generation chambers 12, that is, pressure compartments. The pressure generation chambers 12 are formed adjacent to one another in the direction of the width (short side) thereof. An anisotropic etching method is used to form the pressure generation chambers 12 from the opposite-surface side of the fluid channel formation substrate 10. An ink supply passage 14 and a communication passage 15 are formed next to one end of each of the elongated pressure generation chambers 12 in the direction of the length thereof. The walls 11 are formed as partitions partially between the pressure generation chambers 12, partially between the ink supply passages 14, and partially between the communication passages 15. A communicating portion 13 is formed next to one ends of the communication passages 15. The communicating portion 13 is formed as a part of the reservoir 101, which serves as a common ink chamber (liquid chamber) for the plurality of pressure generation chambers 12. That is, individual liquid flow passages (i.e., fluid channels) each of which is made up of the individual pressure generation chamber 12, the shared communicating portion 13, the individual ink supply passage 14, and the individual communication passage 15 are formed in the fluid channel formation substrate 10.

Each of the ink supply passages 14 is in communication with the one end in the length direction of the corresponding one of the pressure generation chambers 12. The ink supply passage 14 has a relatively small sectional area in comparison with that of the pressure generation chamber 12. Each of the communication passages 15 is in communication with the corresponding one of the ink supply passages 14 at one end of the ink supply passage 14 that is opposite to the pressure-generation-chamber-side (12) end thereof. The communication passage 15 has a relatively large sectional area in comparison with that of the ink supply passage 14 in the direction of the width (i.e., short side) of the ink supply passage 14. In the present embodiment of the invention, the communication passage 15 has the same sectional area as that of the pressure generation chamber 12. To sum up, the fluid channel formation substrate 10 has the plurality of partition walls 11 for compartmentalizing itself, where each compartment includes one pressure generation chamber 12, one ink supply passage 14, and one communication passage 15. The ink supply passage 14 has a relatively small sectional area in comparison with that of the pressure generation chamber 12 in the short-side direction. The communication passage 15, which is in communication with the ink supply passage 14, has a relatively large sectional area in comparison with that of the ink supply passage 14 in the short-side direction, specifically, the same sectional area as that of the pressure generation chamber 12 in the short-side direction.

A nozzle plate 20 is bonded to the opening-surface side of the fluid channel formation substrate 10 by means of an adhesive or the like, which forms into an adhesive layer. For example, a thermal deposition/welding film may be used for bonding. The plurality of nozzle orifices 21 described earlier is formed as holes through the nozzle plate 20. Each of the nozzle orifices 21 opens into one end, or more exactly, in the proximity thereof, of the corresponding one of the pressure generation chambers 12. The nozzle-orifice end of the pressure generation chamber 12 is opposite to the end next to which the ink supply passage 14 is formed. The nozzle plate 20 is made of, for example, glass ceramics, silicon single crystal substrate, stainless steel, or the like.

As described above, the elastic membrane 50 is formed on the other surface of the fluid channel formation substrate 10 that is opposite to the opening surface thereof. An insulating film 55 that is made of zirconium oxide ($ZrO_2$) or the like is formed on the elastic membrane 50. Piezoelectric elements 300 are provided on the insulating film 55. The piezoelectric element 300 includes a first electrode 60, a piezoelectric substance layer 70, and a second electrode 80. The piezoelectric element 300 is a layered element including the first electrode 60, the piezoelectric substance layer 70, and the second electrode 80. Generally, either the first electrode 60 or the second electrode 80 of the piezoelectric element 300 is configured as a common electrode, whereas the other thereof as well as the piezoelectric substance layer 70 is individually patterned for each of the pressure generation chambers 12. In this specification, a region of layers that include the piezoelectric substance layer 70 and either the first electrode 60 or the second electrode 80, which are individually patterned for each of the pressure generation chambers 12, is referred to as a "piezoelectric substance activation (actuation) portion", where the piezoelectric substance activation portion indicates a region of layers at which piezoelectric distortion/deflection occurs at the time of application of a voltage to both electrodes. In the present embodiment of the invention, the first electrode 60 is configured as the common electrode of the piezoelectric element 300, whereas the second electrode 80 is configured as the individual electrode thereof. However, the scope of the invention is not limited to such an exemplary structure. The first electrode 60 and the second electrode 80 may be reversed if it is required, or advantageous, because of circuit line patterning, driving circuit layout, or other reasons. Whichever structure is chosen, one piezoelectric substance activation portion is formed for each of the pressure generation chambers 12. In addition, in this specification, the piezoelectric elements 300 and a vibrating plate (i.e., diaphragm) that becomes elastically deformed, that is, changes its position due to elasticity, when driven by the piezoelectric elements 300 are collectively referred to as an actuator device. In the present embodiment of the invention, the first electrode 60 is formed as an electrode that extends throughout the plurality of piezoelectric elements 300 in the array direction thereof. In addition, the first electrode 60 is formed at an area where each of two opposite ends of the first electrode 60 viewed in the length direction of the pressure generation chambers 12 roughly lies over the corresponding ends of the pressure generation chambers 12. In the above example, a combination of the elastic membrane 50, the insulating film 55, and the first electrode 60 functions as the vibrating plate. However, the scope of the invention is not limited to such an exemplary structure. For example, the first electrode 60 only may function as the vibrating plate with the omission of the elastic membrane 50 and the insulating film 55.

A lead electrode 90, which is made of gold (Au) or the like, is connected to the second electrode 80 of each of the piezoelectric elements 300. Voltages are applied in a selective manner to the piezoelectric elements 300 via the lead electrodes 90.

A reservoir portion 31 is formed in a protection substrate 30 at a position where the reservoir portion 31 and the communicating portion 13 face each other. Therefore, the reservoir portion 31 is in communication with the communicating portion 13. The reservoir portion 31 and the communicating portion 13 make up the reservoir 101, which serves as a common ink chamber for the pressure generation chambers 12 as described earlier. The protection substrate 30 includes a piezoelectric-element holding portion 32. A through-hole cavity 33 is formed between the piezoelectric-element holding portion 32 and the reservoir portion 31. The through-hole cavity 33 is formed through the protection substrate 30 in the direction of the thickness of the protection substrate 30. A part of the first electrode 60 and the front ends of the lead electrodes 90 are exposed inside the through-hole cavity 33. A driving circuit 250, which drives the piezoelectric elements 300, is electrically connected to the front ends of the lead electrodes 90 via conductive wires 121.

It is preferable that the protection substrate 30 should be made of a material having substantially the same coefficient of thermal expansion as that of the fluid channel formation substrate 10. For example, the protection substrate 30 should preferably be made of glass, ceramic material, or the like. In the present embodiment of the invention, the protection substrate 30 is made of a silicon single crystal substrate having a surface orientation of (110), that is, the same material as that of the fluid channel formation substrate 10.

A compliance substrate 40, which is made up of a sealing film 41 and a fixation plate 42, is bonded to the protection substrate 30. The sealing film 41 is made of a flexible material having low rigidity (for example, a polyphenylene sulfide (PPS) film). The sealing film 41 seals one end of the reservoir portion 31. On the other hand, the fixation plate 42 is made of a hard material such as metal (for example, stainless steel (SUS)). The fixation plate 42 has an opening 43 at an area corresponding to the area of the reservoir 101. The opening 43 is formed through the fixation plate 42 in its thickness direction as a cutout region. Since the fixation plate 42 has such a cutout structure, it is the flexible sealing film 41 only that seals one end of the reservoir 101.

The first opening 44 and the second opening 45 are formed through the compliance substrate 40 (refer to FIG. 3). As described earlier, the lower supply passage 160 is in communication with the first opening 44 (refer to FIG. 3). The collection passage 140 is in communication with the second opening 45 (refer to FIG. 3). As described earlier, ink supplied from the ink-containing means 5 (refer to FIG. 2) flows into the reservoir 101 through the lower supply passage 160 and the first opening 44. Unused ink is collected toward the ink-containing means 5 for letting out air bubbles and collecting them together with the ink.

The head body I according to the present embodiment of the invention, which has the structure described above, operates as follows. As a first step, ink is supplied from an external ink supply unit, which is not illustrated in the drawings. The inside of the fluid channels from the reservoir 101 to the nozzle orifices 21 is filled with the supplied ink as a result of the ink-filling operation described earlier. Thereafter, in accordance with a recording signal sent from a driving circuit that is not illustrated in the drawings, a voltage is applied between the second electrode 80, which corresponds to each of the pressure generation chambers 12, and the first electrode 60 so as to cause the elastic deformation of the elastic membrane 50, the insulating film 55, the first electrode 60, and the piezoelectric substance layer 70. By this means, the inner pressure of each of the pressure generation chambers 12 is increased, thereby ejecting ink in the form of droplets from the corresponding nozzle orifice 21.

Other Embodiments

Figure 7:
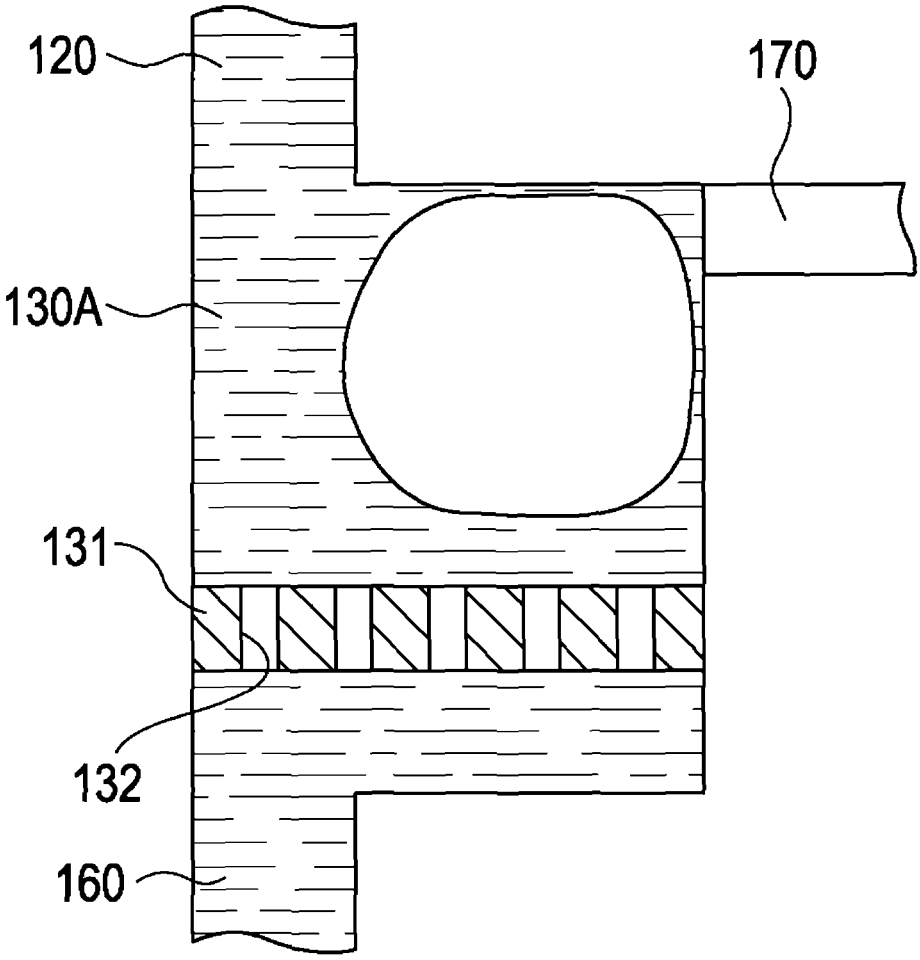
FIG. 7 is a fragmentary sectional view that schematically illustrates an example of the structure of a part of a head according to another exemplary embodiment of the invention.

The scope of the invention is not limited to a structure according to the foregoing embodiment of the invention. For example, though the filter chamber 130 and the supply passage, which is made up of the upper supply passage 120 and the lower supply passage 160, are concentric in the foregoing embodiment of the invention, the filter chamber 130 may be decentered. FIG. 7 is a diagram that schematically illustrates an example of a non-concentric structure according to an exemplary embodiment of the invention. As illustrated in FIG. 7, in the present embodiment of the invention, the upper supply passage 120 is not concentric with a filter chamber 130A, which has an inner diameter larger than that of the upper supply passage 120. That is, the upper supply passage 120 is in communication with a non-center region of the filter chamber 130A at one side. The bypass flow passage 170 is in communication with the filter chamber 130A at the other side.

Since the upper supply passage 120 is not concentric with the filter chamber 130A as illustrated in FIG. 7, an air bubble stagnates inside the filter chamber 130A at a region near the bypass flow passage 170. By this means, it is possible to ensure that the circulatory flow of ink will not be obstructed. In addition, it is possible to allow the air bubble stagnating in the neighborhood of the bypass flow passage 170 to escape through the bypass flow passage 170 to be let out easily. As in the present embodiment of the invention, the inlet of the bypass flow passage 170 may be formed next to the ceiling of the filter chamber 130A.

In the foregoing embodiment of the invention, it is explained that the supply passage is formed as a passage that extends vertically in communication with the filter chamber 130. However, the scope of the invention is not limited to such an exemplary structure. For example, the supply passage may be formed as a passage that extends horizontally in communication with the filter chamber 130. In the foregoing embodiment of the invention, it is explained that ink flows from the upper supply passage 120 toward the lower supply passage 160. However, the scope of the invention is not limited to such an exemplary structure. For example, a suction pump may be provided to make ink flow from the lower supply passage 160 toward the upper supply passage 120. In such a modified structure, the bypass flow passage 170 is formed at the side where the lower supply passage 160 is formed, that is, upstream of the filter 131.

Though a line ink-jet recording apparatus that is equipped with fixed heads is described in the foregoing embodiment of the invention, the invention may be applied to, for example, a so-called serial ink-jet recording apparatus. The term "serial ink-jet recording apparatus" means a recording apparatus that prints an image or the like while moving its liquid ejecting head(s) in the direction orthogonal to the direction of the transportation of a recording target medium. In the foregoing embodiment of the invention, it is explained that the head unit 1 includes four heads. However, the number of heads is not limited to four. For example, the head unit 1 may include one head only.

In the foregoing embodiment of the invention, the ink supply tube 6 through which ink is supplied from the ink-containing means 5 to each of the heads 100 and the ink collection tube 7 through which some ink is collected from each of the heads 100 back into the ink-containing means 5 are described to give an example of flow passages for supply and collection. However, the flow passages for supply and collection are not limited to these tubes. For example, a part of a silicon substrate may be etched away or removed by any other means to form the flow passages for supply and collection.

In the foregoing embodiment of the invention, the ink-jet recording head 100 that discharges ink droplets is taken as an example for the purpose of explaining the concept of the invention. However, the invention can be applied to various kinds of liquid ejecting heads. Liquid ejecting heads to which the invention is applicable encompass a wide variety of heads; specifically, they include without any limitation thereto: a variety of recording heads that are used in an image recording apparatus such as a printer or the like, a color material ejection head that is used in the production of color filters for a liquid crystal display device or the like, an electrode material ejection head that is used for the electrode formation of an organic EL display device, a field emission display device (FED), or the like, and a living organic material ejection head that is used for production of biochips.

What is claimed is:

1. A liquid ejecting head comprising:

a plurality of nozzle openings through which liquid is ejected;

a first flow passage that is in communication with the plurality of nozzle openings, the liquid flowing through the first flow passage;

a circulation flow passage that includes a supply passage and a collection passage, the supply passage being a passage through which the liquid supplied from the outside flows to be supplied to the first flow passage, the collection passage being a passage through which the liquid is collected from the first flow passage to the outside;

a filter chamber that is formed as a widened part of the supply passage and thus has an inner diameter larger than that of the other part of the supply passage, a filter being provided inside the filter chamber, the filter having surfaces that extend transversely across the supply passage, a plurality of holes being formed through the filter; and a bypass flow passage that extends from the side of the filter chamber at a portion of the filter chamber upstream the filter to the collection passage such that an upstream part of the supply passage upstream of the filter is in direct bypass fluid communication with the collection passage through the bypass flow passage thereby allowing bubbles to pass from the filter and out the collection passage, wherein an inner diameter of the bypass flow passage is greater than a diameter of a hole of the plurality of holes of the filter, the inner diameter of the bypass flow passage is larger than a diameter of the nozzle opening, and a flow passage resistance of the bypass flow passage is larger than a flow passage resistance of the circulation flow passage from a branch point where the bypass flow passage branches from the supply passage to a junction point where the bypass flow passage merges into the collection passage.

2. The liquid ejecting head according to claim 1, wherein the bypass flow passage is formed at an upstream side with respect to the filter of the filter chamber above a midpoint of the filter chamber in a vertical direction.

3. A liquid ejecting head unit that includes a plurality of the liquid ejecting heads according to claim 2.

4. A liquid ejecting apparatus that includes the liquid ejecting head according to claim 2.

5. A liquid ejecting apparatus that includes a plurality of the liquid ejecting heads according to claim 2.

6. The liquid ejecting head according to claim 1, wherein the supply passage is not concentric with the filter chamber.

7. A liquid ejecting head unit that includes a plurality of the liquid ejecting heads according to claim 1.

8. A liquid ejecting apparatus that includes the liquid ejecting head according to claim 1.

9. A liquid ejecting apparatus that includes a plurality of the liquid ejecting heads according to claim 1.

10. A liquid ejecting apparatus that includes a plurality of the liquid ejecting heads according to claim 1 wherein the bypass flow passage is located within the head.

11. A liquid ejecting apparatus that includes a plurality of the liquid ejecting heads according to claim 1 wherein the bypass flow passage is communicated with the circulation passage by way of a collection passage.

* * * * *